US010426676B2

(12) United States Patent
Matan et al.

(10) Patent No.: US 10,426,676 B2
(45) Date of Patent: Oct. 1, 2019

(54) WHEELCHAIR CLIMB SYSTEMS AND ASSEMBLIES

(71) Applicants: Daniel Matan, Bnei Brak (IL); Yavgeni Torgovizki, Holon (IL)

(72) Inventors: Daniel Matan, Bnei Brak (IL); Yavgeni Torgovizki, Holon (IL)

( * ) Notice: Subject to any disclaimer, the term of this patent is extended or adjusted under 35 U.S.C. 154(b) by 127 days.

(21) Appl. No.: 15/657,024

(22) Filed: Jul. 21, 2017

(65) Prior Publication Data

US 2018/0021193 A1 Jan. 25, 2018

Related U.S. Application Data

(60) Provisional application No. 62/364,961, filed on Jul. 21, 2016.

(51) Int. Cl.
*A61G 5/06* (2006.01)

(52) U.S. Cl.
CPC ..... *A61G 5/06* (2013.01); *A61G 5/061* (2013.01); *A61G 5/068* (2013.01)

(58) Field of Classification Search
CPC ..... A61G 5/061
See application file for complete search history.

(56) References Cited

U.S. PATENT DOCUMENTS 3,227,465 A * 1/1966 Massie ..... A61G 5/061 188/85
3,295,858 A * 1/1967 Addison, Jr. ..... A61G 5/061 280/11
4,061,199 A * 12/1977 Last ..... A61G 5/061 180/8.2
4,556,229 A 12/1985 Bihler et al.
5,036,959 A * 8/1991 Sarro ..... A61G 5/1018 188/2 F
6,338,496 B1 * 1/2002 O'Neill, Sr. ..... A61G 5/107 280/250.1
6,341,784 B1 * 1/2002 Carstens ..... A61G 5/061 180/8.2
7,396,023 B2 * 7/2008 Vlk ..... A61G 5/065 280/249
7,540,504 B2 * 6/2009 Ehman ..... A61G 5/02 280/5.2

(Continued)

FOREIGN PATENT DOCUMENTS

FR 2845892 A1 * 4/2004 ..... A61G 5/061

*Primary Examiner* — Kevin Hurley
(74) *Attorney, Agent, or Firm* — Carrie M. Stroup

(57) ABSTRACT

The present invention relates to a curb climbing system for a wheelchair having a pair of rear larger drive wheels, a pair of small caster wheels, and a static hand grip for a caregiver being located at a back region behind an occupant seat; the system comprises: (1) a rear rollover-climb lever mechanically linked to a pivot to permit the caregiver located at the back-end region of the wheelchair to apply a downwards forceful thrust sufficient to shift the lever from an upward-position to a downward-position; and (2) a mechanical torque engagement system to translate the downwards forceful thrust to a rollover rotation torque around a pivot point on a stair-like curb, to climb over the stair-like curb. During climb procedure, a ratchet system provides unidirectional backwards rotation of the rear wheel pair and prevents forward rotation to block the wheelchair from rolling down the stairs for safety.

10 Claims, 7 Drawing Sheets

(56) References Cited

U.S. PATENT DOCUMENTS

| | | | | |
|---|---|---|---|---|
| 7,850,189 | B2 | 12/2010 | Barber et al. | |
| 8,844,959 | B2 * | 9/2014 | Winter | B62M 3/00 280/244 |
| 9,445,960 | B2 * | 9/2016 | Abughaida | A61G 5/061 |
| 2014/0300079 | A1 * | 10/2014 | Rhodes | A61G 5/061 280/304.1 |

* cited by examiner

WHEELCHAIR CLIMB SYSTEMS AND ASSEMBLIES

PRIORITY CLAIM

This application claims the priority from U.S. Provisional Patent Application Ser. No. 62/364,961 filed Jul. 21, 2016, which is hereby incorporated by reference in its entirety.

FIELD OF THE INVENTION

This invention relates generally to wheelchairs, and more particularly to wheelchairs that can climb stairs and cross obstacles.

BACKGROUND

The prior art discloses wheelchair systems that can climb stairs and curbs, although not with ease or necessarily in a safe manner that protects against the wheelchair slipping out of control down the stairs.

For example, U.S. patent Ser. No. 7,850,189 that issued Dec. 14, 2010 to Barber et al. discloses a curb climbing wheelchair system having left and right-side attachments that are designed to be attached to the left and right-side portions, respectively, of a standard wheelchair to enable a wheelchair occupant to climb a curb, bump or other obstruction without the aid of another individual. Each attachment includes a ramp extending from a telescoping arm that is designed to be attached, via a clamping system, to one side of the wheelchair. When not in use, the ramps are folded and stowed away on the sides of the wheelchair. During use, the ends of the ramps are placed on the curb to allow the wheelchair occupant to climb the curb. To retrieve the ramps, the wheelchair occupant moves the telescoping arms, if necessary with the aid of an attached circular handle, to lift the ramps thus allowing the wheelchair occupant to grab the ramps. The retrieved ramps then are stowed away until needed. Unfortunately, with this wheelchair design it is physically demanding and time consuming for the wheelchair occupant to setup and store the ramps whenever they run into an obstacle. It also appears that the wheelchair ramps cannot be used with a flight of stairs, and it limited to overcoming curbs and other small obstacles.

Additionally, U.S. patent Ser. No. 4,556,229 that issued Dec. 3, 1985 to Bihler discloses an apparatus comprising rotating flat tracks that is attached to the bottom of a wheelchair for moving the wheelchair on a flight of steps like a conveyor belt. The apparatus has a support adapted to engage underneath the wheelchair when it is in upright condition. Two or more tracks allow the wheelchair to move over uneven terrain and up and down stairs. A safety device is connected to a latch for blocking the latch from moving into the freeing position when the tracks are inclined at more than a predetermined angle to the horizontal. Thus, the wheelchair cannot be released from the support-tracks when it is moving on an incline. Never-the-less, the apparatus must be deployed every time the wheelchair faces an obstacle, but the apparatus is not easily stored or deployed from the wheelchair.

An object of the present invention is to solve these problems by providing a wheelchair that can be pulled up a flight of stairs, or over obstacles, by a caregiver pulling on the back of the chair, and thus not require a second helper lifting the front of the wheelchair; nor does it require the deployment of ramps or similar apparatuses; and it comprises a safety mechanism to prevent the wheelchair from rolling down the stairs if the caregiver loses control.

SUMMARY OF THE INVENTION

The present invention relates to a curb climbing system for a wheelchair having a pair of rear larger drive wheels, a pair of small caster wheels, and a static hand grip for a caregiver being located at a back region behind an occupant seat; the system comprises:

(1) a rear rollover-climb lever mechanically linked to a pivot to permit the caregiver located at the back-end region of the wheelchair to apply a downwards forceful thrust sufficient to shift the lever from an upward-position to a downward-position; and (2) a mechanical torque engagement system to translate the downwards forceful thrust to a rollover rotation torque around a pivot point on a stair-like curb, to climb over the stair-like curb.

In some embodiments, the rollover rotation torque swings the force of gravity vector extending from the center of gravity of the wheelchair to pass from a first side of the pivot point on the stair-like curb to the opposite side of the pivot point; and thereby climb over the stair-like curb.

The system can comprise a gear set coupling the rollover-climb lever to said at least one wheel; the gear set includes an input gear and an output gear and having a ratchet mechanism linked to the rollover-climb lever, the ratchet mechanism:

(1) permits application of the downwards forceful thrust to shift the lever from an upward-position to a downward-position to translate the downwards forceful thrust to the rollover rotation torque around the pivot point; and (2) prevents torque transmission from the lever upon reciprocal lever backwards shift to the upward-position.

In one embodiment, repeated shifts of the lever from the upward-position to the downward-position are translated to a unidirectional rollover rotation torque on at least one wheel of the pair of rear larger drive wheels.

In some embodiments, the system can have torque ratio between the input gear and the output gear selected from the range of 1:1 to 1:3.

The rollover rotation torque on the rear larger drive wheels can be a combination torque of forces applied by the caregiver using the rollover-climb lever and a concurrently applied force of the occupant using a hand-gripped rim mounted on the rear larger drive wheels.

The pair of small caster wheels can be mounted on a pair of telescopic side arms; each side arm is radially mounted on an arm pivot on the wheelchair frame; the telescopic arm is designed to have a contracted state defining a first radial length (R1) between the arm pivot and small caster wheels and an extended state defining a second radial length (R2) between the arm pivot and small caster wheels. The switching between the contracted state and the extended state is controlled by a triggering mechanism configured and operable from the back region of the wheelchair to shift the pair of telescopic arms from the contracted state to the extended state.

In some embodiments, the system further comprises a caster angle system to permit the caregiver to adjustably fix the caster angle ($\alpha°$) of the caster front wheels, such that each of the four wheels have a focal contact point on the ground during stair climbing (or declining) to counteract the torque applied by the occupant weight to flip-over the center of weight, forward.

In some embodiments, each of a pair of telescopic arms comprise an inner member and an outer member; the inner member is sized so as to be receivable and telescopically movable within the outer member, said inner member is positioned at the distal end of the telescopic arm, such that being in the contracted state the outer member portion substantially surrounds said inner member portion, and during the extended state the inner member extends beyond the distal end of the outer member exposing the inner member length.

A kinetic thrust storage mechanism can be mechanically fixed to the inner member and be linked to the triggering mechanism such that upon actuation of the triggering mechanism, kinetic thrust is released to shift the pair of telescopic arms to the extended state.

DESCRIPITION OF THE DRAWINGS

These and other objects and advantages of the present invention will become clear from the following description with reference to the accompanying drawings, wherein.

DETAILED DESCRIPTION OF THE INVENTION

Figure 1:
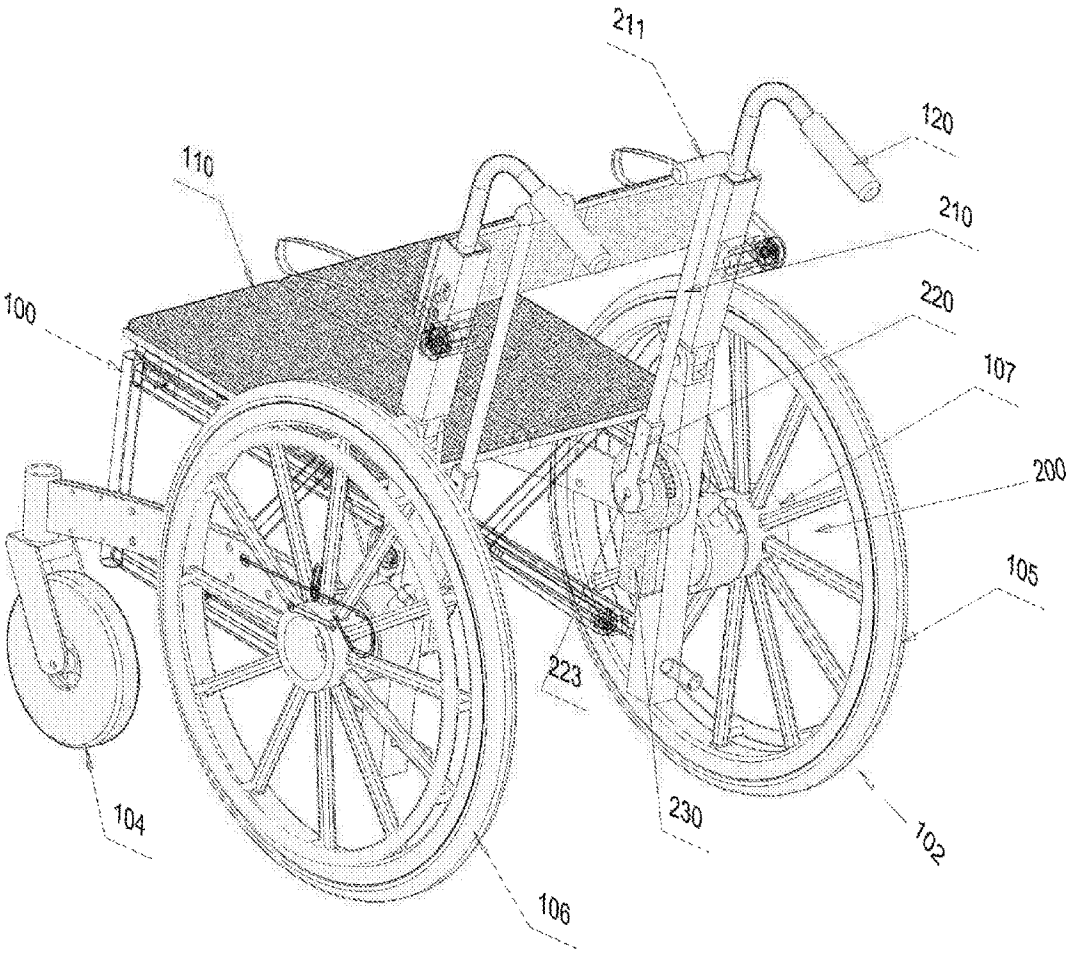
FIG. 1 is a schematic perspective image of the wheelchair having the rollover-climb system in one embodiment of the present invention.

FIGS. 1-6 illustrate the overall structure of one or more embodiments of a stair climbing wheelchair carrier of the present invention given in explanation of its functions. The same elements are given the same reference numerals in the drawings and description thereof will not be repeated for each of the drawings.

As used herein, "have", "having", "include", "including", "comprise", "comprising" or the like are used in their open-ended sense, and generally mean "including, but not limited to."

FIG. 1 shows a schematic image of a self-propelled wheelchair 100 comprising a lever rollover-climb system 200 in one aspect of the present invention.

The wheelchair has a pair of larger rear-end wheels 102 typically with hand-gripped rims mounted thereon and further a pair of smaller castor wheels 104. For the purpose of the present invention, the pair of larger rear-end wheels 102 comprise a RH (Right-Hand) rear wheel 105 and LH (Left Hand) rear wheel 106. Each rear-end wheel rotates around a wheel hub 107 from which the wheel radiates. The rear wheel hubs 107 are respectively attached to their paired rear drive axles (not shown in FIG. 1). The wheelchair typically comprises a pair of rear drive axles; one for the RH rear wheel and a second for the LH rear wheel.

The wheelchair comprises a seat 110 for the occupant. Wheelchair 100 is manually operated and self-propelled by a caregiver. The caregiver maneuvers the wheelchair from the back-end region behind the occupant seat. One of the novel features of the present invention is the providing of a self-propelled wheelchair that can safely climb a staircase without a front-end caregiver. In the present invention, self-propelled wheelchair means an un-motorized wheelchair (without any motorized drive engine).

During forward and backward motion along a horizontal plane at zero-climb-angle, the caregiver maintains his hands on the back-static handles 120 to maneuver the wheelchair, as in a standard wheelchair.

The present invention uses a rollover-climb system 200 to improve the caregiver ability to climb a staircase safely while the patient is occupying the chair (i.e. the "wheelchair occupant"). The rollover-climb system 200 comprises: a rollover lever 210, a rollover lever crank 220 and a rollover mechanism housed within gearbox 230. The rollover lever 210 has a proximal and a distal end. Typically, about the distal end of the lever 210 there is a mounted lever handle 211 which provides easy grip for the caregiver being located at the wheelchair back region (in relation to the occupant seat).

The proximal end of the rollover lever 210 is received within a lumen (not shown) of a rollover lever support hub or crank arm 220. The rollover lever support hub can be adapted for permitting insertion of the rollover lever into the rollover lever support hub. In FIG. 1, rollover lever 210 is shown to be fixedly fastened therein. In some embodiments, the rollover lever is locked within the rollover lever support hub via a lock plate which locks the rollover lever in the rollover lever support hub lumen (not shown).

Alternatively, lock-pin(s) can be used to lock the rollover lever within the rollover lever support hub 220. The hub is utilized to guide the rollover lever during the revolving movement around the rollover hub pivot 223.

The rollover-climb lever is mechanically linked to the rear drive axle and the rear-end wheels. The rollover-climb assembly of the present invention is typically called into action after the larger rear-end wheels were guided in a backwards-motion to strike (or touch) a solid obstacle (as a curb). The solid obstacle there-after provides a pivot point for the wheelchair to rollover-climb the obstacle.

Figure 2A:
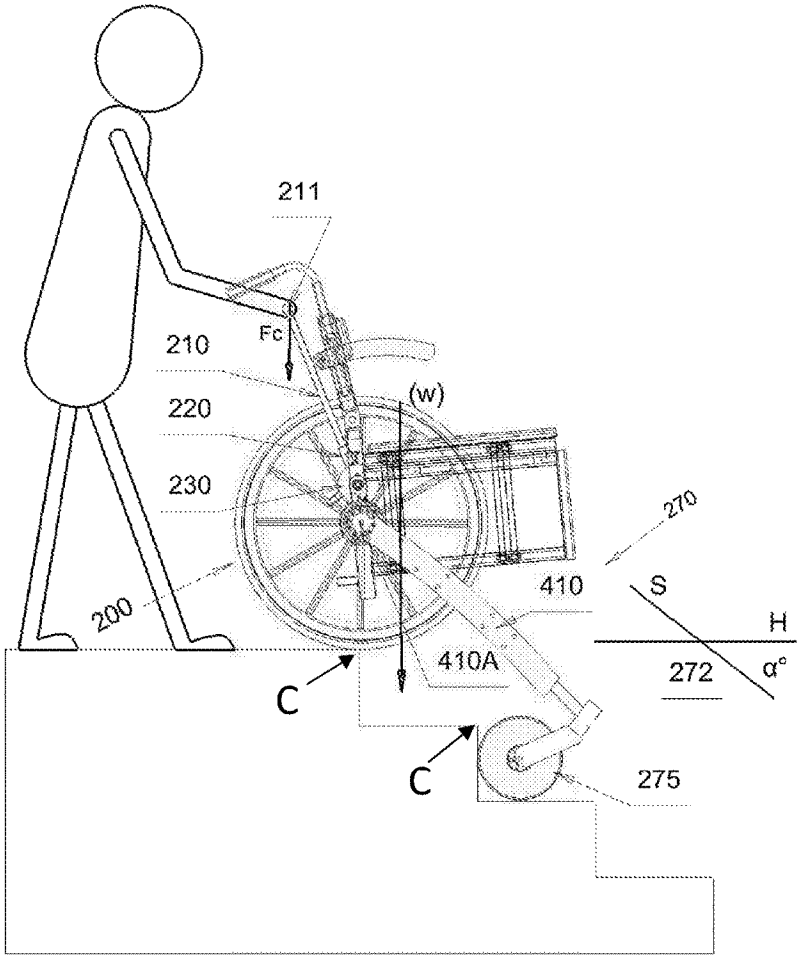
FIG. 2A is a side view of the wheelchair having the rollover-climb system where the rollover lever is shown in an upward position.
Figure 2B:
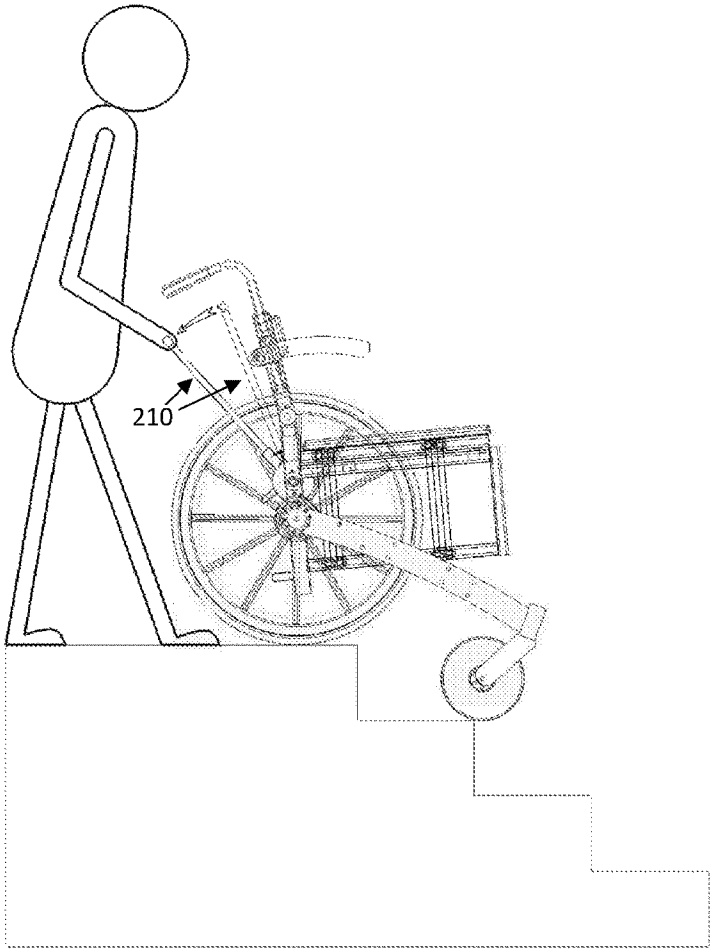
FIG. 2B is a side view of the wheelchair having the rollover-climb system where the rollover lever is shown in a downward position.

FIG. 2A and 2B exemplify the functionality of the rollover-climb assembly.

FIG. 2A shows the wheelchair as it is being lifted upwards along a slope (designated as S). The slope is having a climb angle (designated as $\alpha°$, 272) with respect to horizontal plane H having a zero-climb angle. Slope S, exemplified in FIG. 2A, comprises curbs (or a staircase). Also shown in FIG. 2A, is the force of gravity vector (w) passing through the center of wheelchair/occupant gravity.

The rollover lever 210 is shown as being in an upward position (further referred to as the first state). At this stage, the caregiver force, Fc, is not applied. Prior to the actuation of the rollover-climb assembly, the caregiver maintains his hands on the static handles and carefully guides the rear larger wheels in backward-motion to strike (or touch) a solid obstacle having an obstacle tip, designated as C. The solid obstacle tip C provides a pivot point for the wheelchair to rollover-climb the solid obstacle.

Following the positioning of the rear larger wheels to contact the solid obstacle C, the caregiver can shift his hands to grip the rollover lever handles 211. Then, pressing the rollover lever 210 downwards (FIG. 2B, second state) exerts a rollover rotation torque on the rear axle of the larger wheel pair. The rollover rotation torque causes the force of gravity vector (w) extending through the center of gravity (of the occupied wheelchair) to horizontally pass through the obstacle tip C. As shown in FIG. 2B, the rollover-climb procedure is essentially over and the caregiver can glide the wheelchair to tackle the next curb, if it exists.

Application of a rollover rotation torque to the rear drive axle provides additional force countering the gravity vector (w) and thus facilitating rolling the center of gravity over a pivot point, the tip of the solid obstacle. The pivot point operates as a fulcrum for rollover lever 210, which is sufficiently long to permit the occupant/wheelchair lifting. In some embodiments, the length of the rollover lever measured from the distal end to the axle 223 is in the range of 600 mm to 950 mm. It should be appreciated that such application of rotation torque using a rollover lever over the pivot point permits the safe manual climbing of the wheelchair.

The rollover-climb assembly 200 permits the caregiver located at the back-end region to apply a downwards press on the rollover lever 210 so that a rollover rotation torque is applied in turn on the rear drive axle. In one embodiment, the rollover rotation torque can be combined (added) with the force exerted by seated occupant on the hand-gripped rims to result in an increased rollover rotation torque combining the force being applied by the caregiver and the force being applied by the seated occupant.

It is one of the special features of the present invention that a downward press applied by a back operating caregiver onto the rollover lever exerts a rollover rotation torque to cause the force of gravity vector extending from the center of gravity of the occupied wheelchair to pass through the pivot point (the critical point, the fulcrum) for lifting the wheelchair to the next level.

Also shown in FIG. 2A, is a caster angle system 270, which adjusts the caster angle 272 of the caster front wheels 275. The caster angle system comprises adjustable side arms 410, further discussed herein below.

Figure 3:
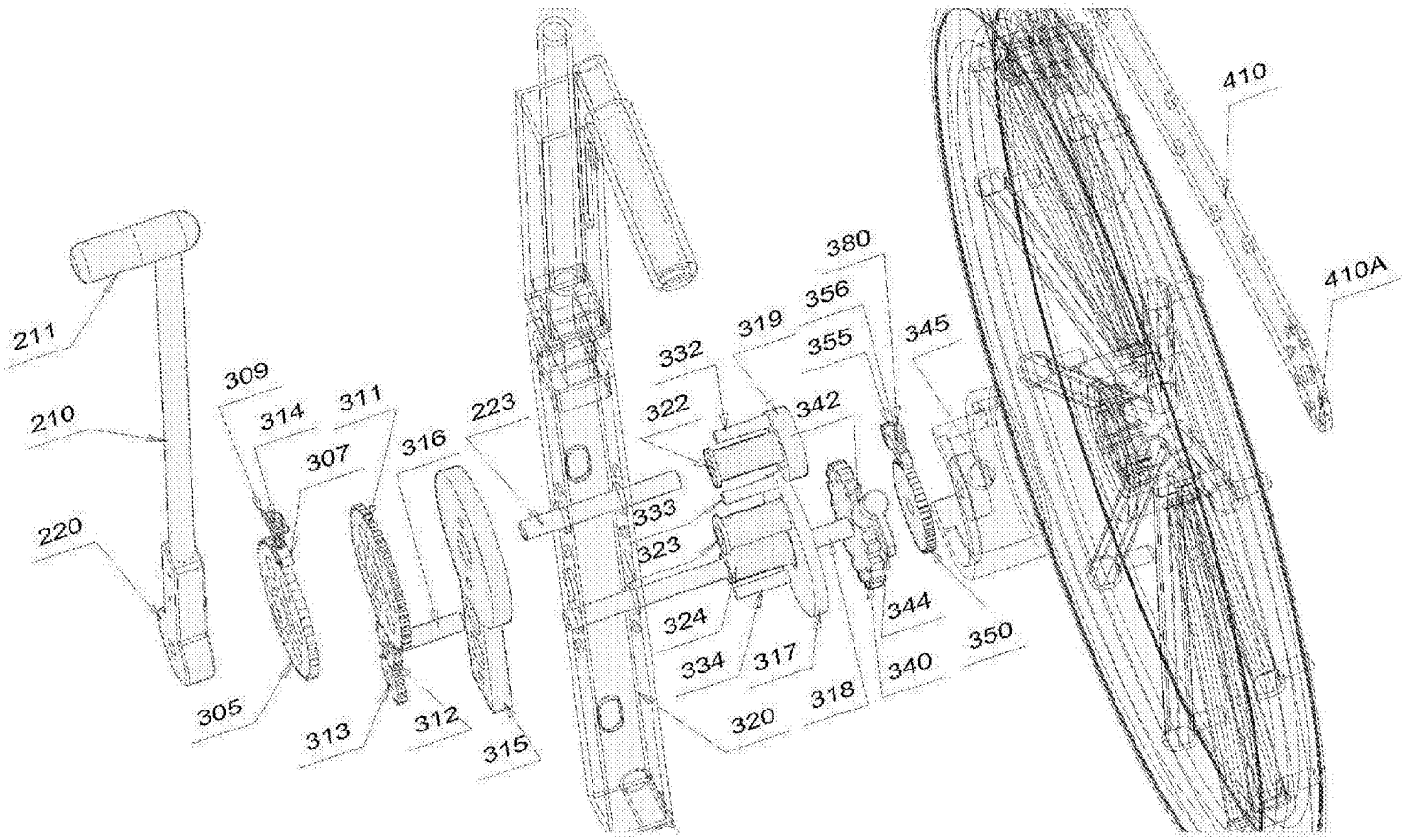
FIG. 3 is an exploded view of a gear set in the rollover-climb system in accordance with one embodiment of the present invention.

With reference to FIG. 3, the rollover-climb system is shown as fitted on the right side of a standard wheelchair and linked to the rear drive axle located on the right side. Similarly, the rollover-climb system can be fitted on the left side of the wheelchair so as linked to the rear drive axle located on the left side.

FIG. 3 further shows one embodiment of a rollover mechanism comprising rollover lever 210 and an arm crank 220 around which the rollover lever partially rotates. About the distal end of the lever there is a mounted lever handle 211 which provides easy hand grip for the caregiver being located at the wheelchair back region.

The proximal end of the rollover lever is received within a lumen of a rollover arm crank 220. The rollover arm crank can be adapted for permitting the rollover lever insertion into a lumen in the arm crank.

Upwards and downwards thrusts which are applied on the rollover lever are translated to input torque to input axle 223. The rollover mechanism is, in typical scenario, fixedly mounted on a sidebar 320 of the wheelchair back frame assembly. The rollover mechanism comprises a ratchet mechanism and mechanically linked gear set.

The ratchet mechanism comprises a ratchet wheel 305 having angled teeth in which driving pawl 307 engages. Spring system 309 maintains the ratchet pawl engagement during motion over the angular teeth of the ratchet wheel. Drive pawl 307 is connected to the rollover lever (or the arm crank) by a mechanical coupling component 314 which is configured to maintain the driving pawl 307 in a fixed position relative to the rollover lever. The ratchet allows a unidirectional lever motion comprising:

(1) permitting application of the downwards forceful thrust to shift the lever from an upward-position to a downward-position and translate the downwards forceful thrust to the rollover rotation torque around the obstacle tip (i.e. the fulcrum); and (2) prevents torque transmission from the lever upon reciprocal lever backwards shift to the upward-position.

Ratchet wheel 305 is connected to gear system 311, 312 and 313 which can advantageously be designed as a spur gear set. In exemplary embodiments, gear 313 is the output gear. The spur gear system comprises sun gears cooperatively linked and pivotally mounted on parallel axles: input axle 223, conveyance axle 316 and output axle 318. The gear system is mounted on inner support plate 315. Inner support plate 315 is cooperatively connected to a complementing outer support plates 317 and 319 via lock pins 332, 333 and 334. In an embodiment, output axle 318 is used as the rear drive axle, linked to the wheel hub 107 (see FIG. 1).

In one embodiment, the torque ratio measured between the input gear and the output gear is 1:3.

In another embodiment, the torque ratio measured between the input gear and the output gear is 1:1. In another embodiment, the torque ratio measured between the input gear and the output gear is in the range of 1:1-1:3.

In a specific embodiment, a differential is coupled and configured to permit different rotation speed for the rear larger wheel and the speed of output gear 313.

Guide sleeves 322, 323 and 324 protects the gear axle, the input axle 223 and the output axle 318 being passed through side bar 320 of the back-frame assembly and tightly maintaining them.

FIG. 3 further shows the operability of the caster angle system (see FIG. 2A, 270). Right side arm 410 is mechanically fixed to side arm hub 410A. It should be appreciated that the left side of the wheelchair can be fitted with an identical caster angle system. Lock pin 342 is insert able into pinhole 345 to engage lock wheel 340. Lock wheel 340 can be fixated to sidebar 320 (directly or indirectly) so that the caster angle is adjustable and fixable in relation with the wheelchair back-frame assembly. A retractable lock pin 342 is configured to fit the groove of teeth pairs in lock wheel 340. The lock pin is connected to cap 344 to allow easy finger grip.

In a locked position, lock pin 342 prevents the rotation of lock wheel 340 and the rotation of adjustable side arm 410; thereby the caster angle remains fixed relative to the wheelchair back-frame assembly. In an unlocked position, lock pin 342 permits the rotation of adjustable side arm 410 and hub 410A around the lock wheel 340 and the rear drive axles; thereby the caster angle 272 (see FIG. 2A) can be adjusted.

Figure 6:
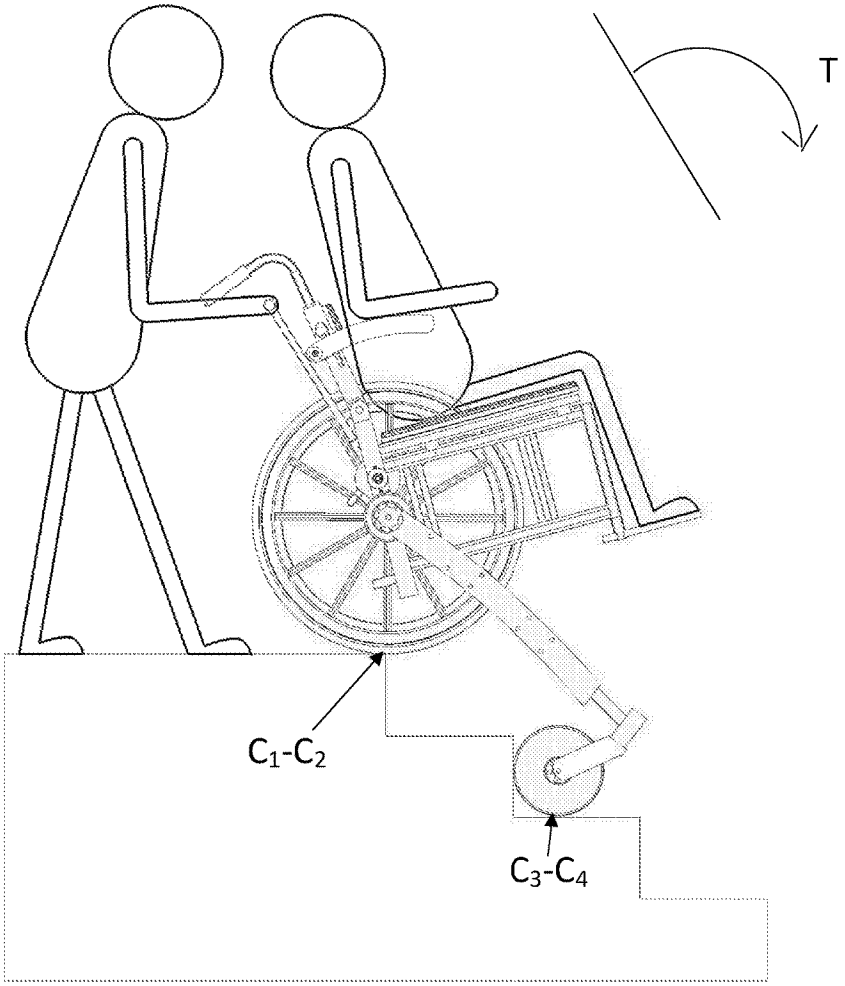
FIG. 6 is a side view of the wheelchair having the side arms in an extended position and 4 focal contact points with the ground is accordance with the present invention.

The unlocked position permits downwards unidirectional adjustment of side arm 410, which can rotate downwards (i.e. "arm drop") until the caster wheels engage contact points on the ground C3, C4. FIG. 6 shows contact points C3 and C4.

Typically, lock pin 342 is unlocked, just in time for slope climbing. After switching to the unlocked position, the caregiver can adjust the caster angle of side arms 410 to about the inclination angle of the slope. Additionally, lock pin 342 can be unlocked, just in time for horizontal drive to allow adjustable side arm 410 to have a fixed angle of about a zero degrees.

The ratchet system 380 further comprises a ratchet wheel 350 having angled teeth in which driving pawl 355 engages. Coiled spring system 356 maintains the ratchet pawl engagement during motion over the angular teeth of the ratchet wheel 350. Drive pawl 355 is mechanically coupled to the wheelchair back frame. During climb procedure, the ratchet system 380 provides unidirectional backwards rotation of the rear wheel pair and prevents forward rotation. This unique feature of the present invention provides increased security during usage. As the caregiver utilizes the rollover-climb lever, ratchet system 380 prevents the wheelchair from slipping forward.

Figure 4:
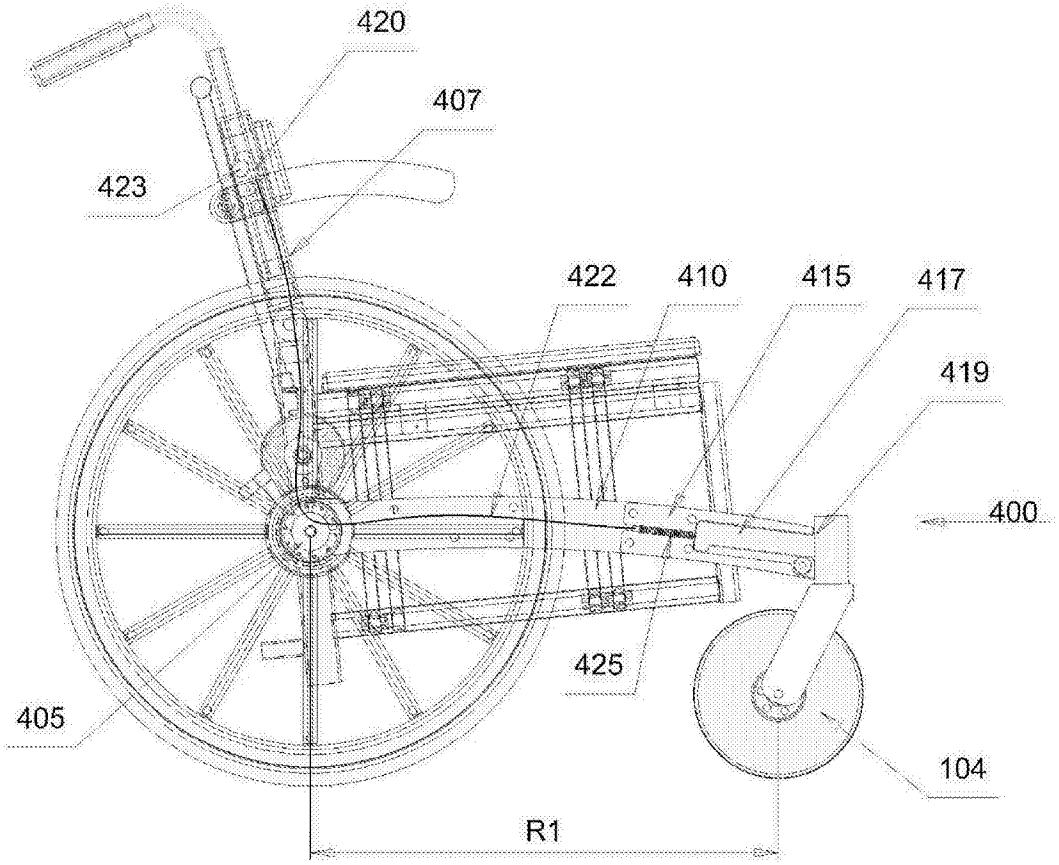
FIG. 4 is a side view of the wheelchair in a contracted state.

Attention is now drawn to FIG. 4 which depicts an embodiment of the caster angle system 400 of the wheelchair in accordance with the teaching of the present invention. In general, the caster angle system 400 comprises a pair of side arms 410 being telescopic side arms. Each telescopic arm is radially mounted on an arm pivot 405 about the wheelchair frame. In some embodiments, the wheel chair frame portion in which the arm pivot is mounted upon is back sidebar 320 (shown in FIG. 3).

The pair of telescopic arms comprise an inner member 417 and an outer member 415. The outer member is fixedly mounted about side arms 410 distal end. Optionally the distal end of side arm 410 and the distal end of the outer member 418 are aligned 419. Inner member 417 is sized to be receivable and telescopically movable within the outer member 415.

Being in the contracted state, the outer member substantially surrounds said inner member portion 417. During the extended state (shown in FIG. 5) the inner member extends beyond the distal end of the outer member exposing the inner member length 505.

In some embodiments, the curb climbing system comprises a kinetic thrust storage mechanism being mechanically fixed to proximal end of inner member 417. Upon actuation of the triggering mechanism 420, kinetic thrust is released to push the inner member 417 to shift the pair of telescopic arms from the contracted state to the extended state.

In an embodiment, the kinetic thrust storage mechanism comprises a contractible metallic action spring 425 linked by metallic thread 422 to a guided cocking lever 423. The cocking lever 423 is guided and movable along a J-shape aperture in the wheelchair frame. Positioning the cocking lever 423 behind the curve of the J-shaped aperture as shown in FIG. 4 will lock the action spring 425 in a contracted state, which maintains maximal kinetic energy ready for the triggering action. Actuating the guided cocking lever 423 over the curve of the J-shaped aperture will now release the action spring 425 to push the telescopic inner member 417 to the extended state.

The back caregiver operating the wheelchair at the back region (behind the seat) can switch between the contracted state and the extended state via utilizing a triggering mechanism 420 configured and operable to shift the pair of telescopic arms from the contracted state to the extended state.

Being in the extended state, the wheelchair demonstrates higher stability (in comparison to the contracted state) in climbing and declining over curbs and preventing forward/backwards flips.

The contracted state of the pair of telescopic arms is now shown in FIG. 4. The contracted state defines R1 radial length being measured from the arm pivot 405 to small caster wheels center 104. The extended state is depicted shown in FIG. 5. The extended state is defining R2 radial length measured from the arm pivot and the small caster wheel center.

The switching by the back caregiver of the caster angle system 400 from a contracted state (having a radial length of R1) to an extended state (having a radial length of R2), provides stability and control. The switching or shifting from a contracted state to an extended state in the radial length measured from the arm pivot 405 to the small caster wheels center 104 provides adaptability capabilities to change R1-to-R2 (or R2-to-R1) in accordance to different staircase size configurations (length and height of rectangular stairs).

Figure 5:
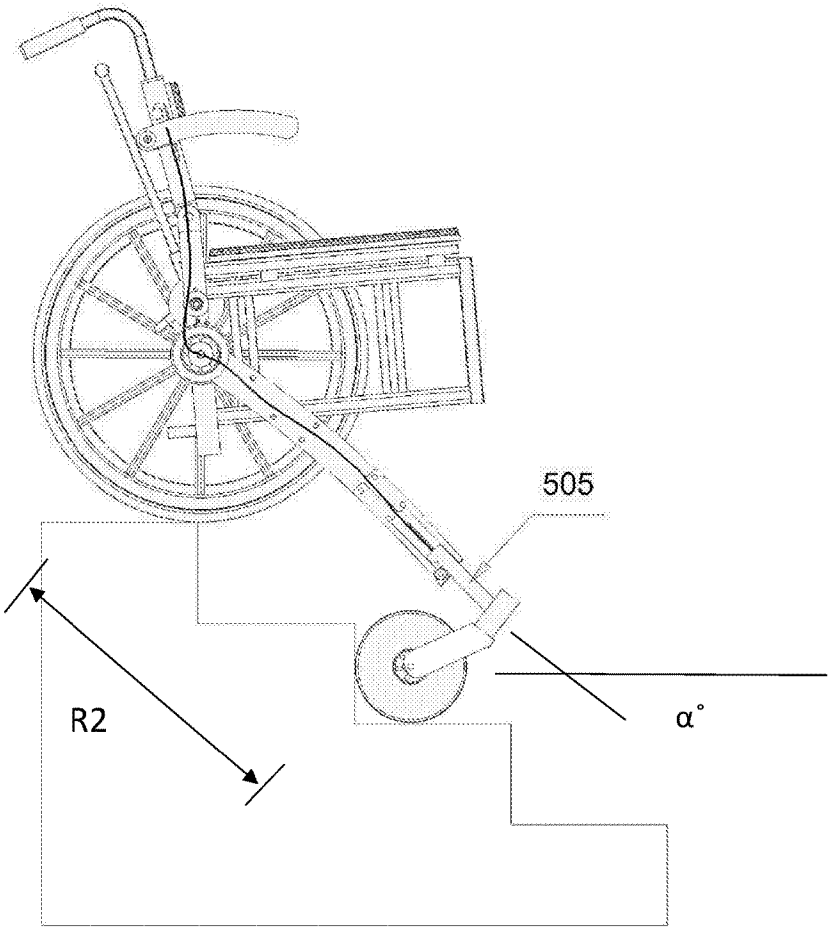
FIG. 5 is a side view of the wheelchair having the side arms in an extended position is accordance with the present invention.

Additionally, the back caregiver can manually adapt the angle of side arms 410 (angle between the side arms and the horizontal line, also shown as a° in FIGS. 2A and 5). A retractable lock pin 342 (see FIG. 3) allows easy finger grip by the back operator to adjust the angle. In the locked position (during active patient conveyance), lock pin 342 prevents the rotation of gear 340 and the rotation of adjustable side arm 410; thereby the caster angle remains fixed (the side arms remain in a fixed angle).

In the unlocked position, lock pin 342 permits the rotation of lock wheel 340 and the rotation of adjustable side arm 410; thereby the caster angle 272 (FIG. 2A, $\alpha°$) can be adjusted such that all four wheels of the wheelchair have focal and horizontal contact points during climb (or indeed decline). Contact points C1-2, and C3-4 are shown in FIGS. 6. C1 and C2 designate the focal contact points of the rear larger drive wheels, right and left sides. C3 and C4 designate the focal contact points of the front caster wheels, right and left sides. C1-C4 defines a rectangle—the area which effects the overall stability of the wheelchair during curb climbing (up/down). As side arms are shifted to the extended state, the area of the rectangle increases and so does the overall stability of the wheelchair.

Continuously having four adjustably fixed horizontal contact points with the ground during climb substantially reduces the patient's risk of forward flipping from the wheelchair. The four focal or horizontal contact points on the ground counteract the torque being built by the patient weight to flip-over the center of weight, forward. In this regard, it should be stated that some countries have adopted regulations requiring the involvement of at least two caregivers while operating the standard manual wheelchair. Therefore, addressing this problem as described herein can reduce patient's risk and reduce the work force of manually handling patient conveyance.

While there has been described what are at present considered to be preferred embodiments of the present invention, it will be understood that various modifications may be made thereto, and it is intended that the appended claims cover all such modifications as fall within the true spirit and scope of the present invention.

What is claimed is:

1. A stair climbing system for a wheelchair having a pair of rear larger drive wheels, a pair of small caster wheels, and a static hand grip for a caregiver being located at a back region behind an occupant seat; the system comprises:

(1) a rollover- climb system comprising a rear rollover-climb lever, a rollover lever crank and a rollover mechanism housed within a gearbox, wherein the rear rollover-climb lever is mechanically linked to the gearbox to permit the caregiver located at the back-end region of the wheelchair to apply a downwards forceful thrust extending downward to a stair step pivot point, and sufficient to shift the lever from an upward-position to a downward-position; and (2) wherein the rollover climb system is configured to translate the downwards forceful thrust to a rollover rotation torque around the stair step pivot point to enable the wheelchair to climb over the stair step.

2. The stair climbing system of claim 1, wherein the rollover rotation torque swings the force of gravity vector extending from the center of gravity of the wheelchair to pass from a first side of the stair step pivot point on the stair step to the opposite side of the pivot point; and thereby climb over the stair step.

3. The stair climbing system of claim 2, wherein the rollover mechanism within the gearbox comprises a gear set coupling the rollover-climb lever to said at least one wheel; the gear set includes an input gear and an output gear and having a ratchet mechanism linked to the rollover-climb lever, wherein the ratchet mechanism:

permits application of the downwards forceful thrust to shift the lever from an upward-position to a downward-position to translate the downwards forceful thrust to the rollover rotation torque around the pivot point; and prevents torque transmission from the lever upon reciprocal lever backwards shift to the upward-position.

4. The stair climbing system of claim 3, wherein repeated shifts of the lever from the upward-position to the downward-position are translated to a unidirectional rollover rotation torque on at least one wheel of the pair of rear larger drive wheels.

5. The stair climbing system of claim 4, having a torque ratio between the input gear and the output gear selected from the range of 1:1 to 1:3.

6. The stair climbing system of claim 5, wherein the rollover rotation torque on the rear larger drive wheels is a combination torque of forces applied by the caregiver using the rollover-climb lever and a concurrently applied force of the occupant using a hand- gripped rim mounted on the rear larger drive wheels.

7. The stair climbing system of claim 5, wherein the pair of small caster wheels are mounted on a pair of telescopic side arms; each side arm is radially mounted on an arm pivot on the wheelchair frame; the telescopic arm is designed to have a contracted state defining a first radial length (R1) between the arm pivot and small caster wheels and an extended state defining a second radial length (R2) between the arm pivot and small caster wheels; the switching between the contracted state and the extended state is controlled by a triggering mechanism configured and operable from the back region of the wheelchair to shift the pair of telescopic arms from the contracted state to the extended state.

8. The stair climbing system of claim 5, having a caster angle system to permit the caregiver to adjustably fix the caster angle ($\alpha°$)of the caster front wheels, such that each of the four wheels have a focal contact point on the ground during stair climbing (or declining) to counteract the torque applied by the occupant weight to flip-over the center of weight, forward.

9. The stair climbing system of claim 7, wherein each of pair of telescopic arms comprise an inner member and an outer member; the inner member is sized so as to be receivable and telescopically movable within the outer member, said inner member is positioned at the distal end of the telescopic arm, such that being in the contracted state the outer member portion substantially surrounds said inner member portion, and during the extended state the inner member extends beyond the distal end of the outer member exposing the inner member length.

10. The stair climbing system of claim 9, comprising a kinetic thrust storage mechanism mechanically fixed to inner member and linked to the triggering mechanism such that upon actuation of the triggering mechanism, kinetic thrust is released to shift the pair of telescopic arms to the extended state.

* * * * *